US005934930A

United States Patent [19]

Camps et al.

[11] Patent Number: 5,934,930

[45] Date of Patent: Aug. 10, 1999

[54] INTERCONNECTION OF TWO ELECTRIC CABLES

[75] Inventors: Didier Camps, Marnaz; Christophe Sibourg, Nantes, both of France

[73] Assignee: Pouyet S.A., Ivry Sur Seine, France

[21] Appl. No.: 08/865,867

[22] Filed: May 30, 1997

[30] Foreign Application Priority Data

Jul. 2, 1996 [FR] France ..... 96 08491

[51] Int. Cl.[6] ..... H01R 4/24

[52] U.S. Cl. ..... 439/425; 439/403

[58] Field of Search ..... 439/925, 403, 439/404, 425, 413; 29/850, 868, 861

[56] References Cited

U.S. PATENT DOCUMENTS

| | | | |
|---|---|---|---|
| 1,231,804 | 7/1917 | Station | 439/98 |
| 4,352,537 | 10/1982 | Guelden . | |
| 4,387,509 | 6/1983 | Dechelette | 29/850 |
| 4,508,399 | 4/1985 | Dowing et al. | 439/404 |
| 5,009,612 | 4/1991 | Rishworth et al. | 439/403 |
| 5,242,313 | 9/1993 | Logorot et al. | 439/404 |

*Primary Examiner*—Neil Abrams
*Assistant Examiner*—J. F. Duverne
*Attorney, Agent, or Firm*—Browdy and Neimark

[57] ABSTRACT

This invention relates to a device for rapidly connecting a user cable on a conductor cable, particularly on ships. It is composed of two interfitting half-boxes each receiving one of the two cables to be interconnected, and which imprison an intermediate plate fitted with double points for interconnection by piercing of the insulation, these points being fixed on this plate in which they are integrated in advance when it is constructed in the factory.

6 Claims, 6 Drawing Sheets

INTERCONNECTION OF TWO ELECTRIC CABLES

FIELD OF THE INVENTION

The present invention relates to a method and a device for rapid inter-connection of two electric cables, for example for producing connections of lighting points along a ship's passageway or for producing points of electrical connection in the industrial, service, building, lighting, etc.sectors.

BACKGROUND OF THE INVENTION

A ship is normally equipped with very numerous permanent lighting points. It is in that case necessary to be able to distribute the electrical energy at a plurality of points which are for example distributed all along the same passageway, from the same three-conductor cable which passes through this passageway. In order to carry out certain localized work, it is also necessary to be able to be connected in parallel on this cable, temporarily and at any useful spot.

The technique employed at the present time consists in providing a succession of sections of cable which are attached high up all along the passageway and whose two ends hang down as far as man's height, for example.

To product lighting points, the adjacent ends of two consecutive cable sections are then each connected on a linkage connector, following which the electric branch cable is connected oil this connector.

This known technique is expensive to exploit, both in material and in manpower costs.

Rapid connectors exist in the present state of the art, for example in accordance with document FR-A-2 720 551, which are fitted with so-called insulation displacing connection contacts or IDC's. The application of such connectors is limited as they can be used only with cables whose wrapped wires are spaced apart from one another, without which a metallic IDC contact might, when it is mounted on a conductor, also touch the core of the adjacent wrapped wire, which would then create a short-circuit between these two wires.

Document U.S. Pat. No. 4,352,537 may also be cited as prior art in the domain of telephony. This document discloses a device for interconnection between telephone cable strands. In order to connect each strand of a first cable, a flat metal contact which comprises two series of double points must be inserted in a respective slot of a common plate. Connection to the wires of the other cable is then effected with the aid of a common connection pusher which may slide along guides provided to that end. The use of this device in practice is delicate and therefore unsuitable for work having to be carried out at an industrial routine and on an industrial scale.

It is an object of the present invention to overcome these drawbacks.

SUMMARY OF THE INVENTION

To that end, it relates to a method for interconnection of two multi-strand cables intended for the distribution of electrical energy, including:

- a first, input, cable which comprises a plurality of active wires which, in projection on at least one plane, are parallel to one another, these wires being surrounded by a common sheath which is the outer sheath of this input cable,
- and a second, output, cable which comprises active wires in register with those of the first cable,

- characterized in that it consists in connecting each active wire of the input cable to the conjugate active wire of the output cable by means of an assembly of double metal points which are incorporated in a common support plate in which they are integrated in advance, during constriction of this plate in the factory,
- each of these metal points being adapted to effect the connection of a wrapped electric wire (i.e. connection by piercing of its insulating sheath until its metal core is reached),
- and each double point comprising two of such points electrically connected together, of which a first point is prominent on a first face of the plate which is then directed by the operator towards the active wires of the first cable, and a second point prominent on the other face of this plate which is consequently directed by the operator towards the conjugate active wires of the other cable, in order to effect, by a relative displacement of all the plate with respect to each of the two cables which makes simultaneous connections for the strands of each of them, the desired interconnection of these two cables.

The invention also relates to a device for carrying out this method, this device for the interconnection of two multi-strand cables for distributing electrical energy being characterized in that it is composed of:

- a box made in two interfitting halves, viz. a first half which receives the output cable and a second half which at least serves as connection pusher of the input cable,
- and an intermediate interconnection plate which is positioned in the box between the two cables then superposed in this box, this plate therefore comprising, in a number at least equal to the number of pairs of wires to be respectively connected (per pair of wires, a wire of the first cable and the conjugate wire of the second cable), one or more pairs of metal conical points which are permanently incorporated in this plate and which are each adapted to make the connection of a wrapped electric wire (i.e. connection by piercing of the insulating sheath until its metal core is reached), and each pair of points therefore comprising two points electrically connected together, i.e. a first point prominent on a first conical face of the plate and a second conical point prominent in the opposite direction on the second face of the plate, this first point effecting, by pressure, the connection of the wires of the first cable and this second point effecting, by pressure, the connection of the conjugate wires of the other cable.

Said box is advantageously shaped so that the upper half-box may also serve as the connection pusher of the output cable when the assembly of the box incorporating the plate is closed.

BRIEF DESCRIPTION OF THE DRAWINGS

The invention will be more readily understood only reading the following description with reference to the accompanying drawings, in which:

FIG. 5, show how this intermediate plate is installed in this lower box.

DESCRIPTION OF PREFERRED EMBODIMENT

Figure 1:
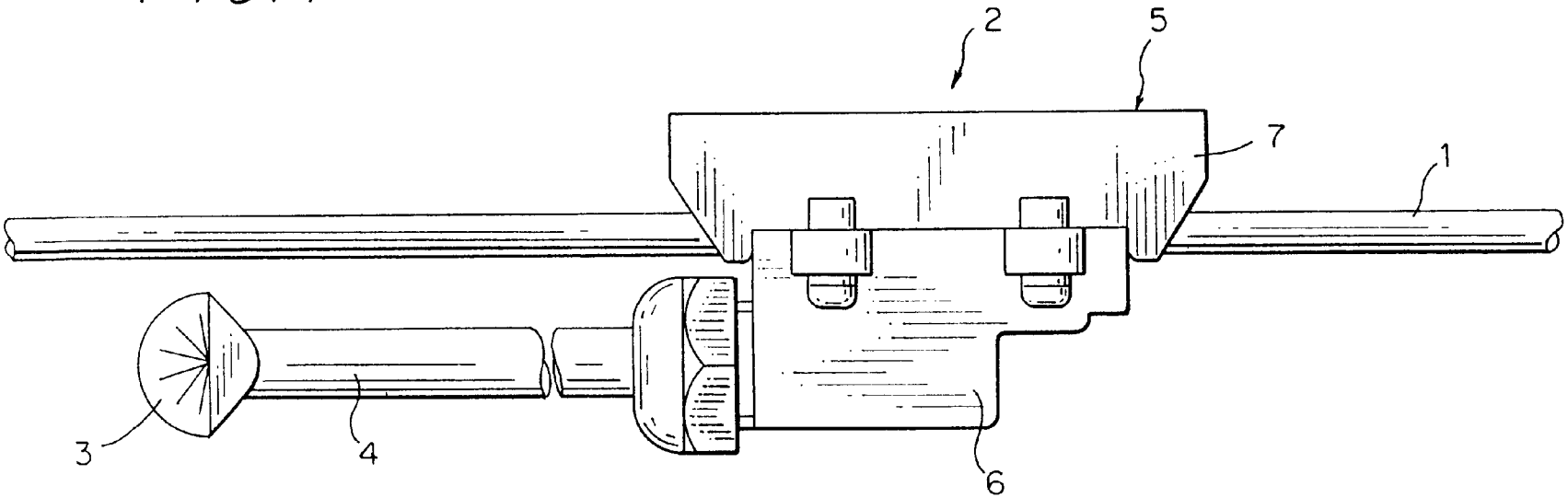
FIG. 1 shows the device of the invention installed on an electrical energy distribution cable, or input cable, to create at that spot a permanent or temporary lighting point.

Referring now to the drawings, and firstly to FIGS. 1 to 6, reference 1 designates a conductor cable which conventionally passes through a ship's passageway in order to distribute electrical energy, temporarily or permanently, at a plurality of selected spots.

The cable is typically flat, of the "bus" type, which comprises, in its insulating sheath, three coplanar conductor wires themselves respectively protected by their insulating sheath. This cable 1 is clearly visible in FIG. 2 and is available on the market.

The device of the invention, here generally designated by reference 2, takes the electrical energy from the conductor cable 1 to distribute it towards a user member, here a lamp 3 for illumination which is connected at the free end of a lighting cable 4, having a length chosen as a function of the point of use, typically of some meters. The lamp 3 is for example a portable lamp which it is desired to connect at that point in order to have light to carry out work.

Like the conductor cable 1, the lighting cable 4 is a cable incorporating three wrapped wires, two conductor wires and one earth wire. It should be noted that this cable 4 does not need to be a flat cable to carry out the invention and, in the present case, it is therefore a three-wire cable of circular section.

The interconnection device 2 comprises a box 5 which is formed by two interfitting halves, a first box half 6 which receives the output cable 4 and a second box half 7 which, as will be seen hereinafter, serves as receptacle and connection pusher of the conductor cable or input cable 1.

Furthermore, an intermediate plate 8 is provided (cf. FIGS. 2 and 3) which is positioned in the box 5, between the two cables 1 and 4 then superposed in this box.

Three grooves 9, 10, 11 for positioning the ends of the three sheathed wires 12, 13 14 (FIG. 4) of the output cable 4 equip the inner part of the first box half or lower half 6.

A stuffing box 15 holds the cable 4 where it enters the box half 6. The end part of the cable 4 which penetrates in the receptacle 6 has been previously stripped of its outer sheath in order to free the three sheathed wires 12, 13, 14

Figure 3:
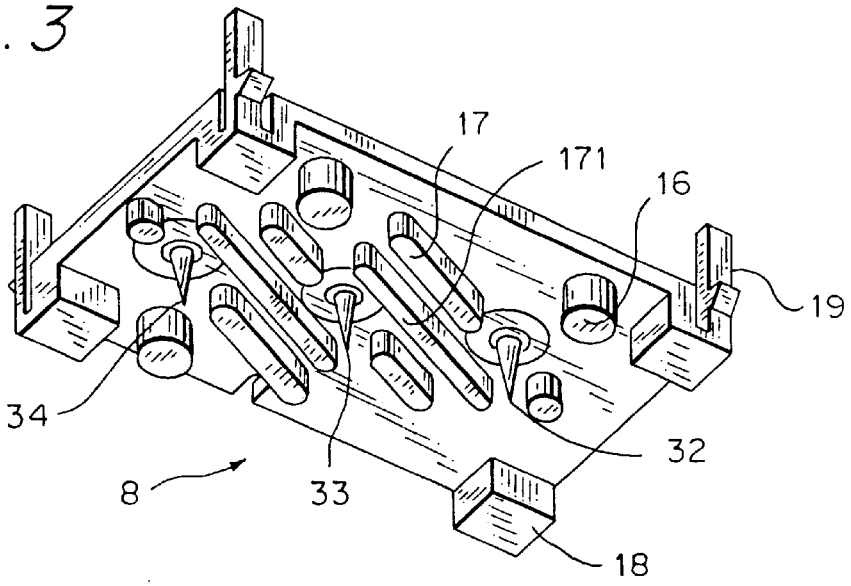
FIG. 3 is a view in perspective of that face of the intermediate interconnection plate which is not visible in FIG. 2.

The plate 8 is designed to be introduced very precisely in the box half 6 and its lower face (cf. FIG. 3) is consequently provided with guiding bars 17 for holding the wires in grooves 9, 10, 11, and with insulation ribs 171 and guiding studs 16 respectively, which cooperate with conjugate female recess 16' and slots 171' provided to that end in the box half 6. As shown in FIG. 3, the height of guiding studs 16 is greater than the height of the bars 17 and insulation ribs 171 so as to initially guide plate 8 into half box 6 as bar 17 and insulation ribs 171 begin to engage in corresponding recesses 16 and slot 171'.

In addition, feet 18 and clipping tabs 19 ensure firm, positive positioning of this plate 8 in the lower box half 6.

Similarly, the inner part of the other box half, or upper half box 7, is fitted with positioning catches 20 which cooperate with conjugate cavities 21 made in columns 72 fast with the other face, or upper face in the drawings, of the plate 8.

The half boxes 7 and 6 are respectively provided with conjugate tabs and bottomless cavities 23, 24 for clipping, which ensure closure of half-box 7 on half box 6, firmly imprisoning the intermediate plate 8 as well as the lower cable 4 and the upper cable 1.

On one side of the lower half-box 6 arc located two slideways 25 adapted to receive, as will be seen hereinafter, two shaft ends 26, borne by a lateral column 27 of the half box 7, the assembly allowing the lower half box 6 to make a movement of rotation about axis 26, followed by a movement of translation along slideways 25, in order finally to ensure closure of the box 5 in accordance with FIG. 1, as will be described hereinafter.

Various members, such as conjugate grooves 28, 29 and guide plates 30 ensure correct positioning of the input cable 1 in the box 5 and sealing members 31 are even provided, where this cable 1 enters and leaves the box 5, to avoid pollution or penetration of humidity in the inner part of this box once the connection is effected.

Figure 2:
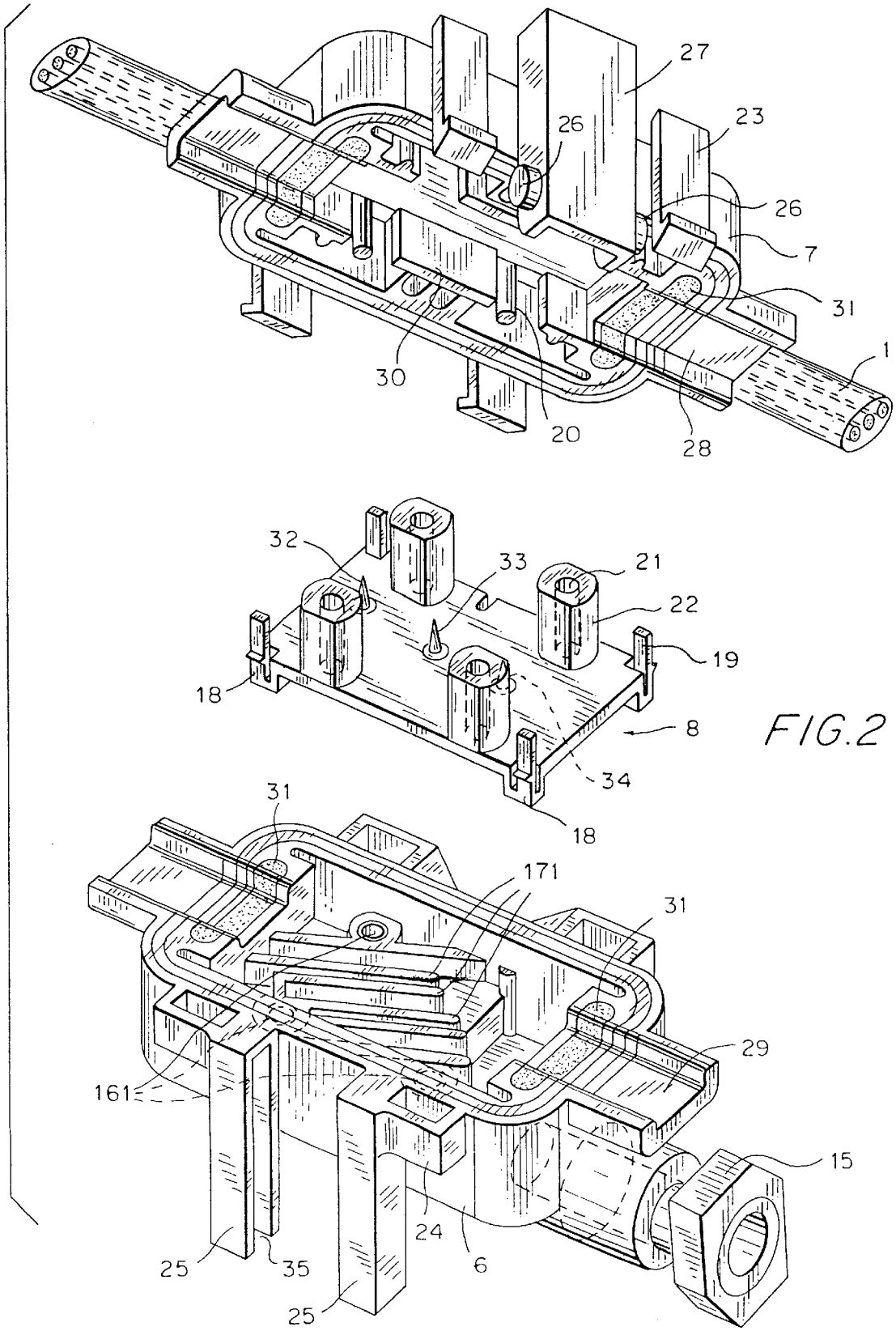
FIG. 2 shows this same interconnection device in an exploded perspective view.

In accordance with an essential aspect of the invention, the plate 8 is fitted with three metallic double conical points 32, 33, 34 which are incorporated in advance, i.e. during construction of the plate 8 in the factory, in which plate 8 they are therefore permanently integrated, so that, for each of these double conical points, one point projects upwardly on the upper face of the plate 8, according to FIG. 2, while the opposite coaxial point projects downwardly on the lower face of the plate 8, according to FIG. 3.

These conical points, which are therefore connected in advance to the plate 8, during construction thereof in the factory, and which are therefore integral therewith, are each adapted to ensure the connection, i.e. by piercing the insulation, on the one hand, of the three wires 12, 13, 14 thanks to the positioning of lower points to penetrate through the longitudinal axis of grooves 9, 10, 11 and wires 12, 13, 14, and, on the other hand, penetration of the three respective conjugate wires of the cable 1 thanks to the corresponding upper points.

Figure 4:
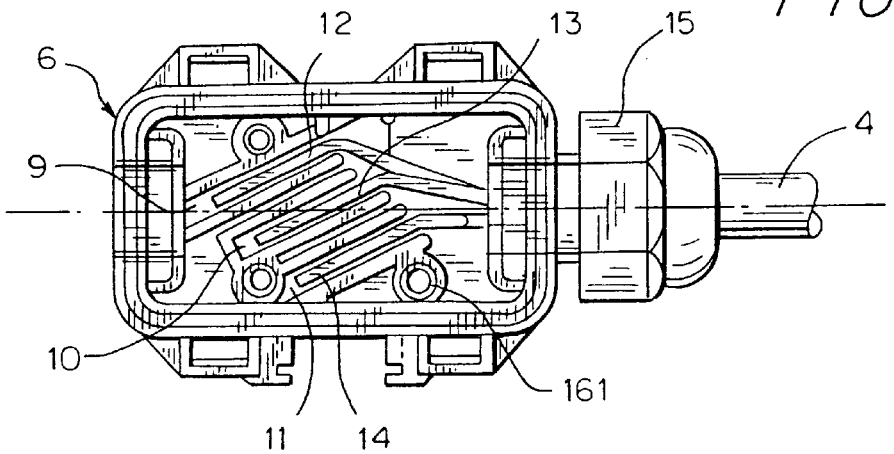
FIG. 4 is a plan view of the lower box of FIG. 2, showing how the lighting cable, or Output cable, is placed in position in this box.
Figure 5:
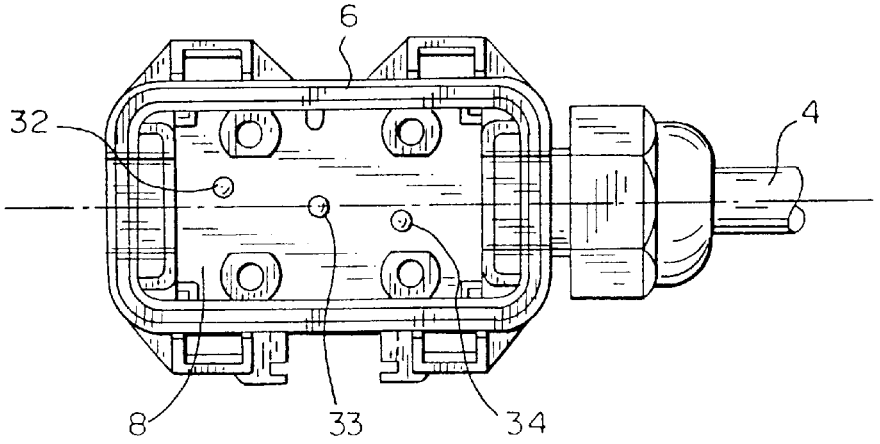
FIG. 5 which is a view similar to FIG. 4.
Figure 6:
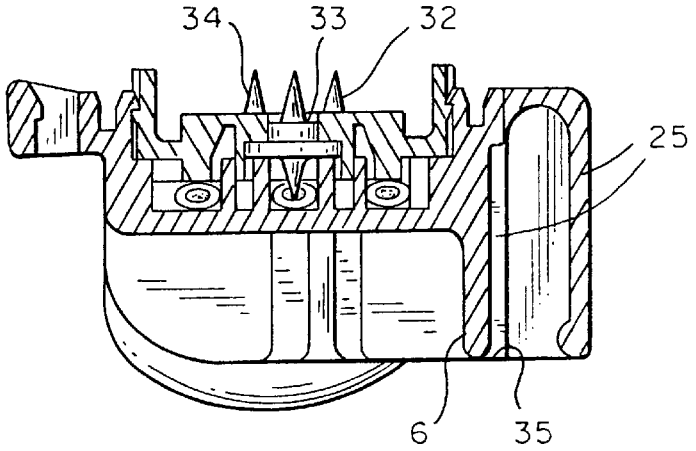
FIG. 6 which is a transverse section of this
Figure 7:
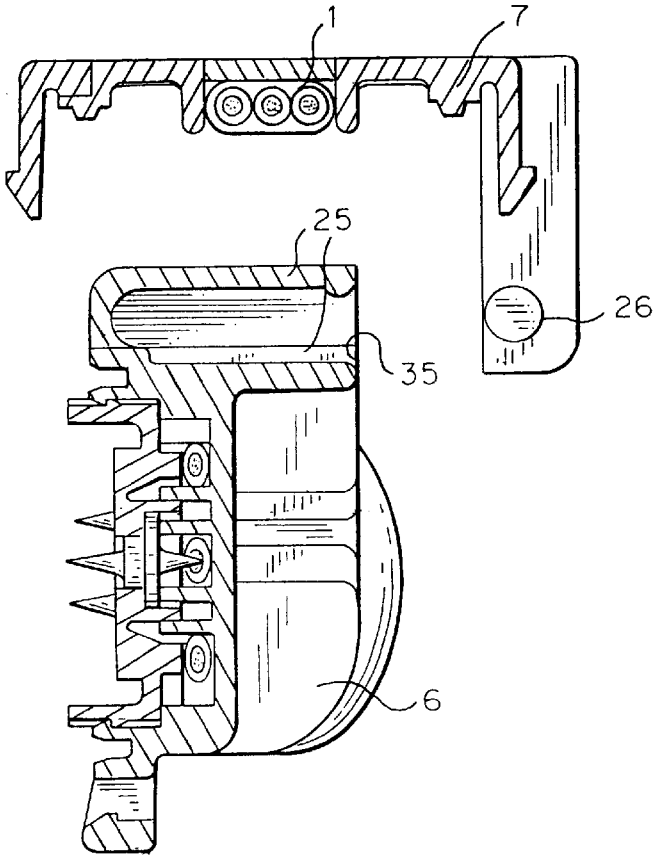
FIGS. 7 to 10 show how this device is then used for making this lighting point by connecting on a conductor cable, arriving at the result shown schematically in FIG. 1.

FIGS. 4, 5, 6 show how, in accordance with one of the multiple possibilities of implementation of the invention, the end, previously stripped of its outer sheath, of the cable 4 is positioned (FIG. 4), then (FIGS. 5 and 6), how the plate 8 is introduced by force in the lower box 6, which causes the conical points 32, 33, 34 to penetrate in the respective wrapped wires 12, 13, 14, these points then being electrically connected to these wires. This first action may be carried out either in the workshop or on the site, which in that case enables the cable 4 to be cut exactly to the required length.

At this stage, the lower part of the connection device 2 of the invention is ready to be installed in situ and connected to the chosen point on the conductor cable 1.

Such connection in situ is effected as follows (cf. FIGS. 7 to 10 in this respect).

The upper half-box 7 is firstly (FIG. 7) positively placed in position, thanks to its guide members 28, 30 mentioned above (FIG. 2), astride the conductor cable 1. Then still according to FIG. 7, the half-box 6, fitted according to FIG. 6 with the cable 4, is turned through 90° in the direct sense in order to present the openings 35 of the slideways 25 opposite the shaft ends 26.

Figure 8:
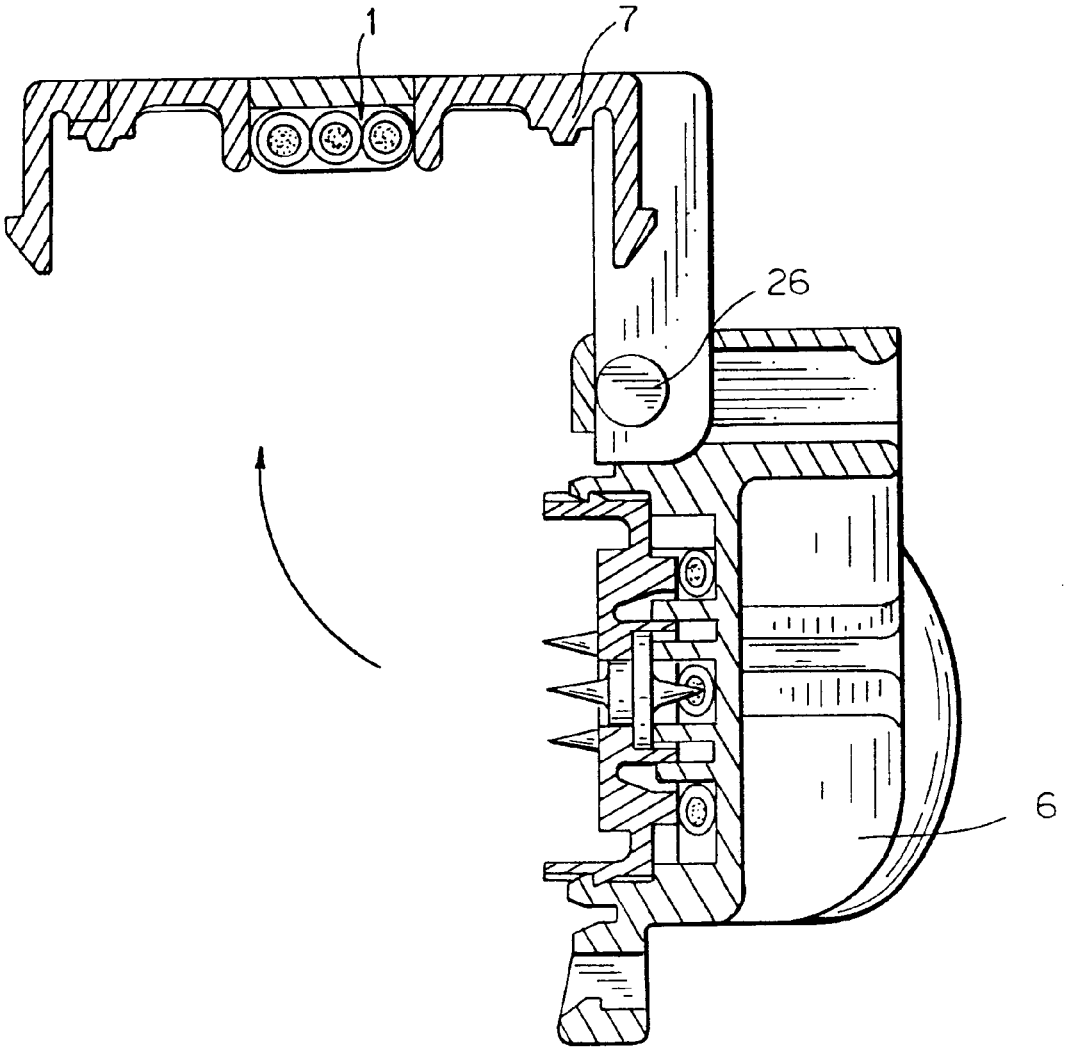

According to FIG. 8, these slideways are then introduced completely around these two shaft ends, with the result that, finally, the lower half-box 6, still fitted with the cable 4, may rotate as indicated about axis 26 in order, according to FIG. 9, to be positioned exactly below and plumb with the upper half-box 7.

In a variant, the connector may be delivered with parts 6 and 7 assembled on the grooves 35 and the shafts 26, which avoids the preceding steps.

Figure 9:
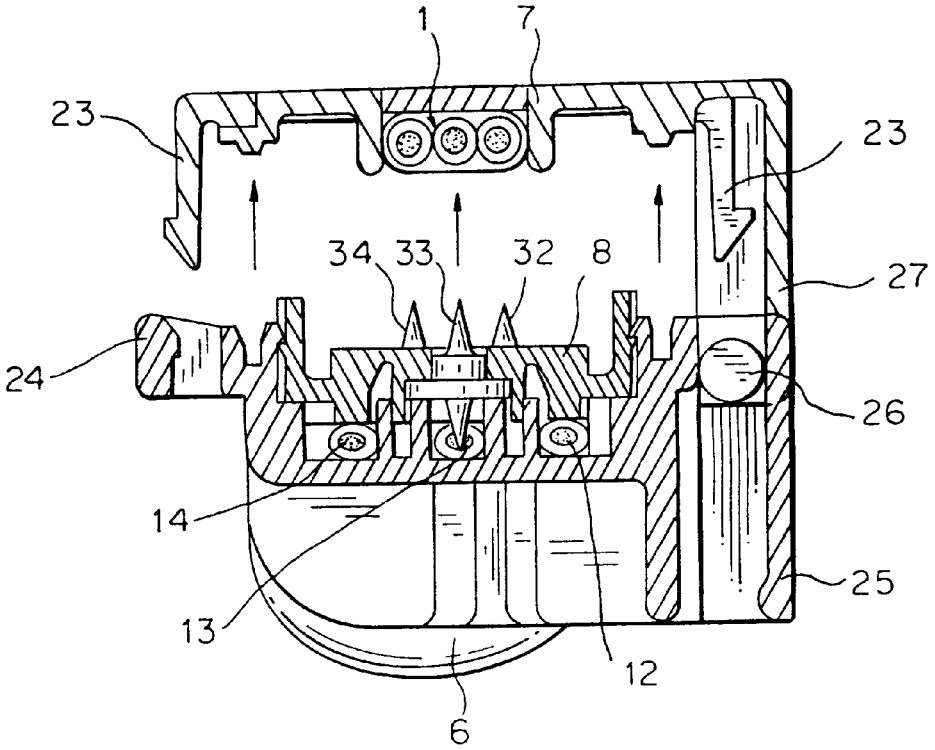
Figure 10:
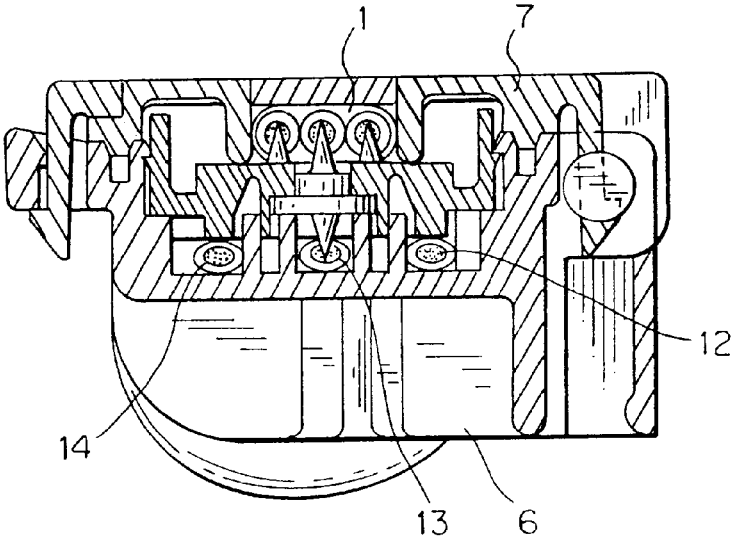

According to FIGS. 9 and 10, the lower half-box 6 is then subjected to an upward vertical translation to bring it closer to the upper half-box 7 and fit it firmly therein.

During this operation, the slideways 25 slide along the lateral column 27, guided by the two shaft ends 26, and the clipping tabs 23 penetrate in their conjugate bottomless cavities 24.

At the end of passage (FIG. 10), the three upper conical points 32, 33, 34 pierce the cable 1 and are respectively connected, by piercing of the insulation, on its three wires, of which they then ensure positive interconnection with their three conjugate wires 12, 13, 14 of the lower cable 4.

It should be noted that the lower cable 4 may be of any type, provided that it contains the desired number of useful conductors. On the other hand, the points 32–34, the plate 8 which bears them, and the inner structure of the upper half-box 7 must be adapted to the morphology of the cable 1, and in particular to the arrangement of the useful wires that it contains.

It goes without saying that the invention is not limited to the embodiment which has just been described.

The bearing on the intermediate plate 8 to connect the output cable 4 may also be effected by closing the box 5 with the aid of the upper half-box 7.

It is also possible to provide the simultaneous connection of the output (4) and input (1) cables in one sole movement of closure of the box 5.

This connector is preferably intended to be used on a conductor cable 1 as shown in the drawings, i.e. a structurally flat cable of the "bus" type, in which the useful wires are therefore coplanar and virtually adjacent. Nonetheless, it is possible to adapt the half-box 7 and the plate 8 to other sorts of conductor cables, for example cables which are not flat and contain non-coplanar conductor wires: in such a case, the conical points 32–34 should in principle have different lengths adapted to the position of their conjugate wires in the conductor cable. However, it is, of course, necessary that the active wires, or useful wires, of the conductor cable be, in projection on the horizontal plane (according to the present drawings), parallel to one another. Furthermore, it is preferable, but not compulsory, that the double points which are each constituted by two conical points directed in opposite directions, be each constituted by two coaxial points, the essential being that these two points (of the same double point) are electrically connected together.

What is claimed is:

1. A device for interconnection of two multi-strand cables intended for the distribution of electrical energy, said multi-strand cables including an output cable having a plurality of first active wires each being surrounded by an insulating sheath and an input cable having a plurality of second active wires projecting in at least one plane and being parallel to one another, said second active wires each being surrounded by an insulating sheath and all by a common outer sheath, said device comprising, a box made in two interfitting halves, a first half of said two interfitting halves engaging the output cable and a second half of said two interfitting halves engaging the input cable, and an intermediate interconnection plate positioned in the box between the output cable and the input cable, said plate comprising, in a number at least equal to the number of pairs of wires to be respectively connected from the output cable and the input cable, one or more pairs of metal conical points permanently incorporated in said plate in a transverse direction to a plane of said plate, said pairs of metal conical points each able to pierce insulating sheath of said first and second active wires and electrically connect corresponding wires from said first and second active wires, each pair of conical points comprising a first point projecting from a first face of the plate and a second point projecting from an opposite direction on a second face of the plate, said first point effecting, by pressure, a connection of said first active wires of the output cable and said second point effecting, by pressure, the connection of the corresponding second active wires of the input cable, said first half having first grooves to receive and maintain separation of free ends of said first active wires of said output cable engaged thereon, said plate having projection bars correspondingly insertable in said grooves to engage said free ends in said grooves when said plate is inserted in said first half and said metal conical points are piercing the insulating sheath on said free ends of said first active wires.

2. The device of claim 1, wherein said pairs of points are each constituted by two coaxial points directed in opposite directions.

3. The device of claim 1, wherein said box is shaped so that the second half of the box may also serve, when closing said box incorporating the plate, as a connection pusher of the output cable.

4. The device according to claim 1, wherein slideways (25) are located on at least one side of said first half to engage shaft ends (26) located on the second half, said slideways and said shaft permitting said first half to rotate to a position where said first half can be slid along said slideways into engagement with said second half.

5. The device according to claim 1, wherein said plate has insulating ribs engageable in corresponding second grooves located between said first grooves on said first half.

6. The device according to claim 5, wherein said plate has guiding studs engageable in corresponding recesses on said first half, said guiding studs having a height greater than a height of said projection bars and said insulating ribs so as to align and guide said plate on said first half upon insertion of said guiding studs into said recesses to set insertion of said projection bars into said first grooves and said insulating ribs into said second grooves.

* * * * *